US005766374A

United States Patent [19]

Guillot et al.

[11] Patent Number: 5,766,374

[45] Date of Patent: Jun. 16, 1998

[54] PROCESS FOR PREPARING THE METAL SURFACE OF AN ARTICLE, ESPECIALLY ONE MADE OF STEEL SHEET, FOR DIRECT-ON ENAMELING

[75] Inventors: Louis Guillot, Thionville; Vincent Cholet, Metz; Daniel Vonner, Thionville, all of France

[73] Assignee: Sollac, Puteaux, France

[21] Appl. No.: 710,957

[22] Filed: Sep. 24, 1996

[30] Foreign Application Priority Data

Sep. 28, 1995 [FR] France ..... 95 11376

[51] Int. Cl.[6] ..... C23C 22/78

[52] U.S. Cl. ..... 148/254; 148/256; 205/183

[58] Field of Search ..... 148/256, 254; 205/183

[56] References Cited

U.S. PATENT DOCUMENTS

| | | | |
|---|---|---|---|
| 2,569,453 | 10/1951 | Chester et al. . | |
| 2,809,907 | 10/1957 | Cramer | 148/256 |
| 2,983,634 | 5/1961 | Budininkas | 148/256 |
| 3,753,870 | 8/1973 | Hoffmann | 204/93 |

FOREIGN PATENT DOCUMENTS

| | | | |
|---|---|---|---|
| A-1237493 | 11/1960 | France . | |
| A- 2020356 | 7/1970 | France . | |
| A-2196400 | 3/1974 | France . | |
| 0163050 | 12/1959 | U.S.S.R. | 205/183 |

*Primary Examiner*—Sam Silverberg

*Attorney, Agent, or Firm*—Oblon, Spivak, McClelland, Maier & Neustadt, P.C.

[57] ABSTRACT

Process in which the said surface is pickled and then treated in two steps, a first treatment step of so-called "amorphous" phosphatization, suitable for depositing a coat of at least 0.2 g/m$^2$, followed by a second treatment step called "nickel plating".

In this way, it is possible to limit the amount of sludge at pickling while at the same time obtaining good adhesion of the enamel.

In a complete sequence for manufacturing an article formed from direct-on enameled metal sheet, the sheet may be formed after pickling, especially after the first step called phosphatization and before the second step called nickel plating.

5 Claims, 1 Drawing Sheet

PROCESS FOR PREPARING THE METAL SURFACE OF AN ARTICLE, ESPECIALLY ONE MADE OF STEEL SHEET, FOR DIRECT-ON ENAMELING

FIELD OF THE INVENTION

The invention relates to a process for preparing metal surfaces for enameling, especially those of steel sheet.

In order to enamel a sheet, it is possible to deposit successively on the sheet a "ground" enamel coat and then an enamel coat called "glaze" coat.

The ground enamel coat serves as a coat for bonding to the sheet.

The glaze coat is the finishing coat.

However, it is also possible to enamel a sheet without using a bonding coat, therefore without a ground coat: this is commonly called "direct-on" enameling.

In direct-on enameling, just as in any enameling technique, it is also possible to superimpose several glaze enamel coats.

In order to enamel a sheet using a direct-on method, by direct application of a glaze coat, the metal surface to be enameled is prepared so as to obtain, in particular, good adhesion of the enamel coat to the sheet.

Overall then, in order to produce an article such as a cooking pot or saucepan enameled using a direct-on method, a sheet is formed, its surface is prepared and coated with a glaze enamel frit and the enamel is baked.

PRIOR ART

In order to prepare a metal surface for direct enameling, a first process is known in which the metal surface is pickled and then the surface is treated using a sulfate solution containing nickel as coat-forming cation; this surface treatment is also called "nickel plating".

The pickling and the surface treatment are generally carried out by dipping or by spraying.

The drawback of this first process is that it requires heavy pickling, corresponding to more than 15 g/m$^2$ of material being removed from the surface to be enameled in order to obtain enamels having properties which are satisfactory from the standpoint of adhesion and surface appearance.

Thus, in this first process, it is currently necessary to remove about 25 g/m$^2$ of material from the surface to be enameled.

This heavy pickling is a drawback insofar as it generates very large volumes of sludge to be treated.

In order to avoid the drawback of treating large volumes of sludge, the document FR 2,593,522 proposes to replace the pickling and the sulfate treatment with a phosphatization process using a solution essentially containing nickel as the coat-forming cation; however, the adhesion of the enamel has proved in this case to be very insufficient, and in any case less than that obtained in the case of the first process mentioned.

Finally, a third surface preparation process is known in which the surface is also treated using a phosphate solution, but after light pickling: in this case, it is important that the solution contain molybdenum, in addition to the nickel as previously.

According to this third process, it would therefore be no longer necessary to pickle the metal surface to be enameled so heavily in order for both the adhesion and surface appearance to be fairly satisfactory: lighter pickling, removing less than 15 g/m$^2$ (per face), would be sufficient.

In this case, an approximately 40% reduction in the amount of sludge generated during the surface preparation is achievable.

Other treatments of this type may be envisaged, for example using solutions containing antimony.

However, according to this third process, the treatment effluent in this case contains heavy metals, in particular molybdenum, and may be expensive to treat.

Moreover, in practice it appears to be difficult to achieve the same levels of enamel adhesion as in the first process described hereinabove, in particular in a reproducible manner.

SUMMARY OF THE INVENTION

The object of the invention is to obtain, on the metal surface of an article, a strongly adherent enamel having a good surface appearance using a sheet preparation generating effluent which is less voluminous and easier to treat.

For this purpose, the subject of the invention is a process for preparing the metal surface of an article, in particular one made of steel sheet, for direct-on enameling, in which the said surface is pickled and then treated, wherein the pickled surface is treated in two steps, a first treatment step of so-called "amorphous" phosphatization, suitable for forming a coat of at least 0.2 g/m$^2$ on the said surface, followed by a second treatment step called "nickel plating".

Strong acids are preferably used for the pickling, which makes it possible to decrease the pickling time.

A coat-forming phosphate solution is therefore used for the amorphous phosphatization treatment; this treatment is known per se, in particular for preparing a sheet for deep drawing.

The nickel-plating treatment is known per se for preparing a surface for direct enameling after heavy pickling and corresponds, for example, to the treatment of the first process of the prior art described previously.

According to a preferred embodiment of the invention, the nickel-plating conditions are fixed so as to obtain a deposition of between 0.5 and 2.5 g/m$^2$ on the surface to be enameled.

Thus, by virtue of the surface treatment according to the invention, comprising two steps, one being amorphous phosphatization and the other nickel plating, it is observed that light pickling is sufficient for reproducibly obtaining an enamel which is both strongly adherent and has a satisfactory surface appearance.

Light pickling is understood to mean pickling corresponding to the removal of at most 15 g/m$^2$ of material, when the surface to be pickled is that of a steel sheet.

By virtue of the invention, the amount of sludge to be treated is therefore limited and the presence of heavy metals in the surface treatment effluent is avoided while at the same time obtaining, by a direct-on method, an enamel coat which is as adherent as that using the first process of the prior art mentioned, namely heavy pickling followed by a single nickel-plating treatment using a sulfate solution.

In order to manufacture a direct-on enameled finished article, such as a saucepan or cooking pot, from a metal sheet, it is necessary for the forming of the sheet to be carried out before the enameling, of course.

As forming, for example by deep drawing, is reputed to destroy the surface preparation for direct enameling, the forming is carried out even before the surface preparation since a sheet which was, in the reverse order, to be pickled and then formed (including oiling and cleaning) would no longer have sufficient surface reactivity for the surface treatment to be effective.

Thus, in the prior art for manufacturing an article from enameled sheet, the succession of manufacturing steps are carried out in the following order:

forming of the articles from a sheet-metal strip, namely in succession oiling, forming proper and cleaning;

surface preparation of the articles, namely pickling and then surface treatment;

enameling proper.

The order of these manufacturing steps has the drawback that it is more difficult to prepare the surface of articles which have already been formed than the surface of a sheet-metal strip; this is because a sheet-metal strip may, in particular, be easily pickled and treated continuously at high speed.

The object of the invention is also to simplify the process for manufacturing an article made of enameled sheet.

For this purpose, the subject of the invention is also a process for manufacturing an article made of direct-on enameled metal sheet, which comprises a forming operation, a surface preparation according to the invention and an enameling operation, wherein the forming operation is carried out after pickling and after the first surface treatment step called amorphous phosphatization.

However, by virtue of the invention, which relates to the two-step treatment of a surface, the pickled and then phosphatized surface retains sufficient reactivity after forming in order to make the nickel-plating treatment effective and give the enamel good adhesion and a good surface appearance.

In order to pickle (and phosphatize) the sheet, advantage may then be taken of very high-performance industrial-scale sheet-metal strip pickling plants.

This novel order of manufacturing operations also provides an additional advantage with respect to the forming since, by phosphatizing beforehand, the tribological properties of the surface, and therefore the lubrication between the sheet and the forming tools, are substantially improved.

Finally, this novel order of manufacturing operations makes it possible to provide already pickled and phosphatized sheets, suitable for direct enameling after a possible forming operation and a simple nickel-plating treatment; from the standpoint of the enameler, he no longer has need of pickling plants and is freed of having to treat pickling sludge.

The invention will be more easily understood on reading the description which follows, given by way of example, and with reference, for Example 3, to FIG. 1.

DESCRIPTION OF THE PREFERRED EMBODIMENTS

Figure 1:
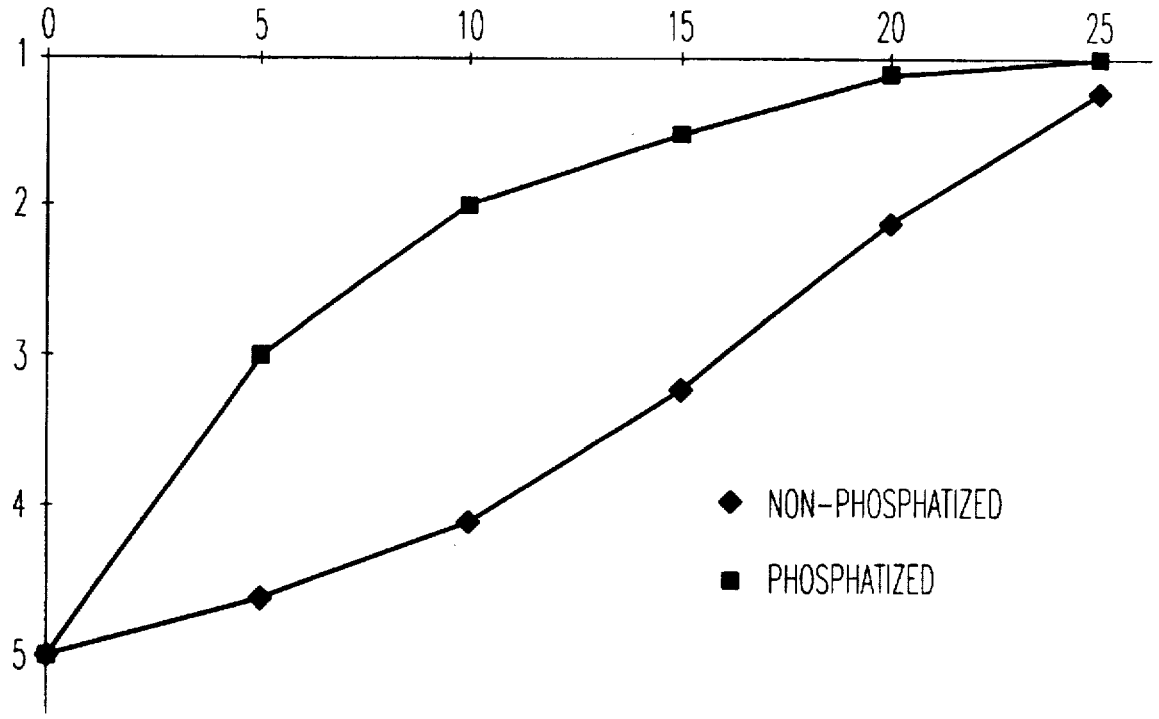
FIG. 1 shows the adhesion of enamel coats for two different surface preparations and as a function of the amount (abscissa axis) of material removed during the prior pickling (g/m$^2$ per face).

The main embodiment of the invention relates to obtaining a metal article to be enameled.

This article is produced by the forming of a sheet-metal blank, here made of steel.

According to the invention, the sheet is pickled and then subjected to a first surface treatment of amorphous phosphatization.

The composition of the pickling bath is known per se; baths based on strong acid, for example sulfuric acid, are preferably used in order to shorten the pickling time.

The pickling conditions are chosen so as to remove at most 15 g/m$^2$ of steel (per face).

The amorphous phosphatization bath is known per se.

The phosphatization conditions are chosen in order to deposit a coat of at least 0.2 g/m$^2$ per face on the sheet to be enameled.

It is preferable to choose a phosphatization solution and application conditions which are suitable for the weight of the coat not to exceed 2 g/m$^2$ per face.

It is preferable to choose a phosphatization solution which is suitable for obtaining a coat based on amorphous sodium, calcium and iron phosphate.

The phosphatization solution used does not contain heavy metals, nor does the phosphatization effluent either.

The rinsing and drying operations which accompany the pickling and phosphatization are known per se and will not be described here in detail.

Still according to the invention, the second surface treatment of the preparation process according to the invention is then carried out.

This treatment is of the conventional nickel plating type using a solution containing nickel cations, this solution being known per se for preparing a metal surface for direct enameling.

The solution contains, for example, sulfate or phosphite anions.

Preferably, the nickel-plating conditions are designed, in a manner known per se, to obtain a deposition of 0.5 to 2.5 g/m$^2$ on the surface of the article to be enameled.

The nickel-plating effluent is that usually found upstream of the direct-on enameling plants of the prior art and causes no particular problem in treating it; an advantage of the invention is that it contains no heavy metals.

The rinsing and drying operations which accompany the nickel plating are known per se and will not be described here in detail.

The article thus prepared according to the invention is now ready for direct enameling.

The article is coated with a single glaze enamel coat which is baked in a manner known per se.

According to the invention, although only a light pickling has been carried out for preparing the surface, an enamel coat is obtained which has strong adhesion and a good surface appearance.

By light pickling is understood to mean pickling corresponding to the removal of at most 15 g/m$^2$ of material if the surface of the article to be enameled is made of steel.

By strong adhesion is meant adhesion at least comparable to that which would be obtained by preparing the surface of the article according to the first process of the prior art mentioned; this process differs essentially from that of the invention by there being more extensive pickling and by there being no phosphatization treatment.

By virtue of the invention, the amount of pickling sludge generated is also much less than that of the first process of the prior art mentioned; the amount of sludge may, in particular, be decreased by 40%.

Finally, still by virtue of the invention, the surface treatment effluent does not contain heavy metals, unlike the third process of the prior art mentioned, which uses treatment solutions containing molybdenum.

The invention may also be employed in the context of a process for manufacturing an article made of direct-on enameled sheet.

For example, the process begins with a strip of sheet steel coming from a cold-rolling mill, more precisely from the skin-pass stand.

According to the invention, the sheet-metal strip is pickled and then subjected to a first surface treatment of amorphous phosphatization.

Advantageously, the pickling and phosphatization treatment are carried out in line after the skin pass, at a high rate, for example at a rate of 30 m/min; the pickling time may be appreciably reduced compared to the pickling times of the preparation processes of the prior art: for example, 2 to 25 seconds compared, commonly, to more than five minutes in the prior art.

As previously, pickling conditions are chosen in a manner known per se in order to obtain strong adhesion of the enamel while still removing at most 15 $g/m^2$ per face.

An amorphous phosphatization bath known per se is used, such as the bath from Parker known commercially by the name Bonderite 901, at a temperature of approximately 60° C.

As previously, suitable phosphatization conditions are chosen in order to obtain a coat or deposition of at least 0.2 $g/m^2$ per face.

The pickling sludge and the phosphatization effluent may be treated in effluent treatment plants which are provided, moreover, for treating the rolling and skin-pass effluent.

The pickled and phosphatized sheet may be coiled and sent to the enamelers, who then carry out the forming and direct-on enameling operations after simple nickel plating.

The pickled and phosphatized sheet may then be regarded as an intermediate commercial product, ready for direct enameling.

Advantageously, the phosphatization treatment provides temporary corrosion protection and prepares for the forming operation.

Depending on the order of the manufacturing process according to the invention, the forming operation is therefore carried out next, before the second surface treatment of the nickel-plating type.

Thus, the sheet is oiled and formed, especially by deep drawing, and the formed workpiece is cleaned, for example in an alkaline solution.

By virtue of the phosphatization treatment, and still using a conventional deep-drawing oil, the coefficient of friction of the treated sheet against the forming tools is lower than with an untreated sheet, which makes the forming operation easier.

Next, as previously, the second surface treatment of the preparation process according to the invention is carried out, namely the nickel plating.

The formed and nickel-plated sheet is now ready for direct enameling.

The sheet is coated with a single glaze enamel coat which is baked in a manner known per se: the article of enameled sheet is then obtained.

According to the invention, and even though the forming is carried out after pickling, an enamel coat is obtained which has adhesion quite comparable to that obtained in the first embodiment; this result indicates that, even after forming, the pickled and phosphatized surface has remained sufficiently reactive for the nickel-plating treatment to be effective.

By virtue of the manufacturing process according to the invention, part of the surface preparation treatment, in particular the pickling, is advantageously shifted to before the forming operation: the pickling may then be carried out continuously on the sheet-metal strip directly downstream of the rolling, on industrial-scale plants of high capacity which benefit from the use of amply sized effluent and sludge treatment plants.

The amorphous phosphatization treatment, which is an integral part of the preparation for enameling, facilitates the forming operation.

The following examples illustrate the invention.

In the following examples, the composition of the treatment solutions and of the depositions produced on the surface of steel sheets is indicated; the analytical methods employed for obtaining these compositions are: "chromatonionic" analysis, atomic absorption and analysis using an inductively coupled plasma for the analyses of a solution, such as for the analyses of a deposition which are carried out after dissolving it.

COMPARATIVE EXAMPLE 1

The purpose of this example is to illustrate the first process of the prior art mentioned in which heavy pickling is carried out followed by a single nickel-plating treatment of the metal surface to be enameled.

The sheet to be enameled is a decarburized steel sheet 1 mm in thickness, called Solfer by Sollac.

The sheet is formed and then cleaned in an alkaline solution.

Next, the sheet is pickled by immersing it in an acid solution containing approximately 70 g/l of sulfuric acid at approximately 70° C. for 6 to 11 minutes.

The pickling time is adjusted in order to obtain a sheet weight loss of 20 to 40 $g/m^2$ per face.

This weight loss is necessary in order to obtain the adhesion properties and surface-appearance characteristics of the enamel to be deposited.

This pickling generates sludge to be treated; the amount of sludge generated is proportional to the intended weight loss.

Next, the pickled surface is treated by immersing it in a nickel-plating solution containing approximately 11 g/l of nickel sulfate, the pH of which has been adjusted to approximately 2.8 by adding sulfuric acid, at approximately 70° C. for 3 to 6 minutes.

The nickel-plating time is adjusted in order to obtain a nickel-plating deposition of between 0.5 and 2.5 $g/m^2$ per face.

Next, the treated surface is coated with glaze enamel.

For example, a liquid white enamel called L138 from Ferro is used and a coat of approximately 300 $g/m^2$ per face is deposited.

Next, the enamel is baked under conditions specific to its composition, in this case approximately 3 minutes at approximately 820° C.

In this way an enameled steel sheet is obtained.

Next, the adhesion properties and surface-appearance characteristics of the enamel are evaluated.

The adhesion of the enamel coat to the substrate of steel sheet is evaluated using Standard EN 10209, which defines a scale of five ratings, from a value of 1 for excellent adhesion to a value of 5 for poor adhesion.

The person skilled in the art evaluates the surface quality in a manner known per se by checking, in particular visually, that there are no defects such as defects of the pitting, bubble or fish-scale type.

The enamel obtained here has an adhesion level of 1 and a surface appearance termed good.

COMPARATIVE EXAMPLE 2

The purpose of this example is to illustrate the third process of the prior art mentioned, in which light pickling is carried out followed by a single treatment of the metal surface to be enameled using a phosphatization solution containing nickel and molybdenum.

The same substrate as in Comparative Example 1 is used, and the forming and cleaning are carried out as previously.

Next, the sheet is pickled by immersing it in an acid solution containing approximately 25 g/l of sulfuric acid at approximately 65° C. for 4 to 12 minutes.

The pickling time is adjusted in order to obtain a sheet weight loss of 5 to 15 g/m$^2$ per face.

Advantageously according to this process, the weight loss at pickling may be approximately 50% less than that in Comparative Example 1 and the amount of sludge produced by the pickling is decreased in the same proportion.

Next, the pickled surface is treated by immersing it in a phosphatization solution at approximately 60° C. for 6 to 12 minutes.

The phosphatization solution is commercially available under the name VP 10091 from Chemetall.

This solution contains mainly the following elements: 15 to 20 g/l of $P_2O_5$, 4 to 6 g/l of sodium, 3 to 4 g/l of nitrates (expressed in $NO_3^-$), 1 to 2 g/l of nickel, 0.5 to 1.5 g/l of sulfates (expressed in $SO_4^{2-}$), 0.5 to 1 g/l of fluorine (expressed in $F^-$), 0.1 to 0.3 g/l of silicon, 0.01 to 0.1 g/l of iron, 0.08 to 0.12 g/l of ammonium (expressed in $NH_4^+$), 0.03 to 0.1 g/l of molybdenum and 0.05 to 0.5 g/l of calcium.

The treatment time is adjusted in order to obtain a deposition of between 1 and 1.5 g/m$^2$ per face.

The phosphatization solution in this case contains heavy metals, especially molybdenum, and produces sludge which may be expensive to treat.

The deposition obtained typically contains the following elements: 0.1 to 0.2 g/m$^2$ per face of $P_2O_5$, 0.05 to 0.1 g/m$^2$ per face of Na, 0.05 to 0.1 g/m$^2$ per face of Ni, 0.05 to 0.1 g/m$^2$ per face of Mo and 0.05 to 0.1 g/m$^2$ per face of Ca.

As may be seen, the molybdenum/nickel ratio is much higher in the deposition than in the treatment solution, which means that molybdenum is deposited preferentially over nickel; thus, the proportion of nickel deposited remains less than that in Comparative Example 1.

Next, the sheet is coated with an enamel frit and baked, as in Comparative Example 1, so as to obtain an enameled steel sheet.

The adhesion properties and surface-appearance characteristics of the enamel are evaluated as previously; the following results are obtained: adhesion: 3, surface appearance: "good".

Thus, as already mentioned in the preamble, this process does not enable the same level of adhesion to be achieved as in the first process of the prior art mentioned (cf. Comparative Example 1).

EXAMPLE 1

The purpose of this example is to illustrate the surface preparation process according to the invention.

The same substrate as in Comparative Example 1 is used again, which is formed and cleaned in an alkaline solution.

Next, the sheet is pickled by immersing it in an acid solution containing approximately 70 g/l of sulfuric acid at approximately 70° C. for 1.5 to 4.5 minutes.

The pickling time is adjusted in order to obtain a sheet weight loss of 5 to 15 g/m$^2$ per face, with the same advantage with regard to the amount of sludge generated as in Comparative Example 2.

Next, the pickled surface is treated by immersing it in a phosphatization solution at approximately 60° C. for 0.5 to 6 minutes.

The phosphatization solution is commercially available under the name Bonderite 901 from Parker.

This solution contains mainly the following elements: 5 to 15 g/l of $P_2O_5$, 10 to 20 g/l of sodium, 0 to 4 g/l of nitrites (expressed in $NO_3^-$), 5 to 20 g/l of calcium and <0.05 g/l for the elements Ni, Mo, Si, Fe, $SO_4$ and F.

The treatment time is adjusted in order to obtain a deposition of between 0.2 and 2 g/m$^2$ per face.

The deposition obtained typically has the following elements: 0.02 to 0.5 g/m$^2$ per face of $P_2O_5$, 0.02 to 0.1 g/m$^2$ per face of Na and 0.2 to 0.5 g/m$^2$ per face of Ca; the nickel and molybdenum contents are not measurable and are less than 0.005 g/m$^2$ per face.

Next, the phosphatized surface is treated by immersing it for 3 to 6 minutes in a nickel-plating solution such as in Comparative Example No. 1.

Next, it is coated with enamel and baked as in Comparative Example 1 in order to obtain an enameled steel sheet.

The adhesion properties and surface appearance characteristics of the enamel are evaluated as previously; the following results are obtained: adhesion: 1, surface appearance: "good".

The degree of adhesion is comparable to that of Comparative Example 1, that is to say to that obtained with the first process of the prior art mentioned.

According to the invention, it was therefore possible to obtain an enamel coat having satisfactory adhesion properties and surface-appearance characteristics while at the same time limiting the amount of sludge generated by pickling and without producing effluent containing heavy metals.

EXAMPLE 2

The purpose of this example is to illustrate the process for manufacturing an article made of enameled sheet according to the invention, in which the forming operation is carried out after pickling, in particular after the phosphatization treatment and before the nickel-plating treatment.

Again, the same substrate as in the Comparative Example 1 is used, which is cleaned in an alkaline solution.

Next, the sheet is pickled by immersing it in an acid solution containing approximately 750 g/l of sulfuric acid at approximately 100° C. for 5 to 15 seconds.

The pickling time is adjusted in order to obtain a sheet weight loss of 5 to 15 g/m$^2$ per face, with the same advantage in terms of the amount of sludge generated as in Comparative Example 2.

Next, the pickled surface is created by immersing it in the same phosphatization solution as in Example 1 at approximately 60° C. for 5 to 25 seconds.

Again as in Example 1, the phosphatization time is adjusted in order to obtain a deposition of between 0.2 and 2 g/m$^2$ per face having approximately the same composition.

According to this variant of the invention, the forming of the phosphatized sheet in order to form an article is then carried out according to a conventional sequence comprising oiling of the sheet, the forming proper and alkaline cleaning.

Advantageously, although a conventional oil is used, the forming is facilitated by virtue of the prior phosphatization treatment: this is because a decrease in the coefficient of friction is observed compared to that observed with the same oil on the same sheet, as rolled or immediately after pickling.

After the forming operation, the metal surface of the article is then immersed for 3 to 6 minutes in a nickel-plating solution as in Comparative Example No. 1.

Next, it is coated with enamel and baked, as in Comparative Example 1.

An article made of enameled sheet is thus obtained.

The adhesion properties and surface-appearance characteristics of the enamel are evaluated as previously; the following results are obtained: adhesion: 1; surface appearance: "good".

The degree of adhesion and the surface appearance are comparable to those of Example 1, which means that the forming operation, although carried out after pickling, has not impaired the surface reactivity obtained at pickling.

According to the invention, to the advantages of Example 1 which have already been mentioned may be added the possibility of carrying out the first surface preparation steps, namely the pickling and phosphatization, on high-output industrial-scale lines, especially immediately on leaving the rolling mill, more specifically the skin-pass rolling stand.

According to this variant of the invention, the forming is also facilitated.

EXAMPLE 3

The purpose of this example is to illustrate, in the surface preparation process according to the invention, the importance of the amorphous phosphatization step in order to obtain good adhesion when only light pickling, of at most approximately 15 g/m$^2$ per face, is carried out beforehand.

On the one hand, a series of comparative specimens is prepared according to the operating method of Comparative Example 1 apart from the difference that the prior pickling conditions are varied in order to obtain various weight losses: respectively 0, 5, 10, 15, 20 and 25 g/m$^2$ per face for the specimens Ec1, Ec2, Ec3, Ec4, Ec5 and Ec6.

On the other hand, a series of specimens is prepared according to the operating method of Example 1, apart from the difference that:

- the prior pickling conditions are varied in order to obtain the same various weight losses: respectively 0, 5, 10, 15, 20 and 25 g/m$^2$ per face for the specimens E1, E2, E3, E4, E5 and E6;
- the amorphous phosphatization conditions (using the same solution called Bonderite 901) are adjusted in order to obtain a weight of phosphatization coat of approximately 1.4 g/m$^2$ per face.

The curve in FIG. 1 represents the adhesion results obtained for the two series of specimens (along the ordinate: 1 for very good adhesion and 5 for poor adhesion) as a function of the amount of material removed at pickling (along the abscissa: 0 to 25 g/m$^2$ per face).

The curve identified by squares—for the "phosphatized" case—corresponds to the specimens prepared according to the invention and the curve identified by diamonds—for the "non-phosphatized" case—corresponds to the specimens prepared according to the prior art with a single nickel-plating operation after pickling.

This example, illustrated by FIG. 1, clearly shows that substantial differences in adhesion are observed between the two surface preparation processes as soon as the pickling removes less than or equal to 20 g/m$^2$ per face, especially when at most 15 g/m$^2$ per face are removed.

FIG. 1 also shows that, in order to obtain sufficient adhesion of the enamel coat when the process according to the invention is carried out, it is expedient that the prior pickling preferably remove greater than or equal to 5 g/m$^2$ per face: the degree of adhesion is then 3; in order to obtain the same degree of adhesion without the amorphous phosphatization operation, it would be necessary to pickle the surface so as to remove at least 15 g/m$^2$ per face.

EXAMPLE 4

The purpose of this example is to show that the pickled and then phosphatized surface retains, after the forming operation, a level of reactivity which is sufficient to make a direct nickel-plating treatment effective and to obtain good adhesion of the enamel coat.

The operation of forming a sheet consists in oiling it, in deforming it, especially by deep drawing, and finally in cleaning it.

Such a forming operation would therefore be likely to damage the phosphatization coat and the subjacent pickling surface, especially because of friction.

It will firstly be shown that the presence of an amorphous phosphatization coat on the sheet facilitates the forming operation insofar as it improves the tribological properties of the surface.

Four specimens are prepared:

- M1: non-phosphatized steel oiled using a protective oil;
- M2: phosphatized steel oiled using a protective oil;
- M3: non-phosphatized steel oiled using a protective oil and then a deep-drawing oil;
- M4: phosphatized steel oiled using a protective oil and then a deep-drawing oil.

By non-phosphatized steel is meant an as-rolled steel which has not been treated.

By phosphatized steel is meant a pickled steel specimen covered with an amorphous phosphate coat of at least 0.2 g/m$^2$, obtained under the following conditions:

- cleaning the specimen in a solution at 90° C. followed by rinsing at 90° C., and finally cold rinsing;
- pickling using a sulfuric acid solution (600 g/l $H_2SO_4$) at 90° C. under conditions suitable for removing 10 g/m$^2$ from each face;
- acid rinsing of the pickled surface followed by treatment using a phosphatization solution called Bonderite (cf. Example 1) at 70° C. for 10 seconds followed by rinsing and drying.

The protective oil is an oil commonly used for providing temporary corrosion protection, especially for sheet storage.

The deep-drawing oil is an oil commonly used for deep-drawing operations, which is suitable for improving the tribological properties of a sheet surface.

The tribological properties of the surfaces of various specimens are measured as follows, all the specimens having the same dimensions.

The specimen to be measured is clamped in a blank holder with a predetermined clamping force $F_s$.

The tribological properties are characterized by then measuring the maximum force $F_d$ for drawing the sheet in the blank holder.

This maximum drawing force $F_d$ is obviously proportional to the clamping force $F_s$.

The lower the maximum drawing force $F_d$ for a given clamping force $F_s$ the superior are the tribological properties of the surface.

For clamping forces $F_s$ between 1 and 6 kN, it is observed that:

for specimen M3, $F_d$ is 3 to 4% less than the measured clamping forces for specimen M1 under the same conditions;

for specimens M2 and M4, $F_d$ is 8 to 11% less than the clamping forces measured for specimen M1 under the same conditions.

It may be deduced from this that the amorphous phosphatization treatment (M2 and M4) improves the tribological properties much more significantly than the application of a deep-drawing oil (M3); this is not only an advantage for the forming operation itself but also limits, a priori, the risk of damaging the surface by friction and therefore contributes to the retention of the surface reactivity.

The retention of surface reactivity in the case of friction is illustrated by the rest of the example.

A specimen of type M2 or M4 is then formed (see above) by deep drawing.

On the formed specimen there may be identified areas called "frictionally-modified" areas and areas called "non-frictionally-modified" areas.

The "frictionally-modified" areas are areas in which the surface has been substantially modified by friction on the deep-drawing tool, therefore areas in which the surface reactivity has been impaired.

In contrast, the non-frictionally-modified areas are areas which do not seem to have suffered particular frictional modification and which have retained the appearance that they had before forming.

After forming, the specimen is subjected to the following operations:

electrolytic cleaning by means of an anodic treatment in a solution at 60° C., at pH≈12, and at ≈10 A/dm$^2$ twice for 30 seconds;

nickel electroplating in a solution at 60° C. at 18 A/dm$^2$ for 6.5 seconds;

porcelain enameling using a composition having the reference L138 from Ferro, the enamel being baked in a tunnel furnace at approximately 820° C.

The adhesion of the enamel to frictionally-modified areas and to non-frictionally-modified areas is measured as previously; the results are as follows:

non-frictionally-modified areas: adhesion=1 (as in Example 1);

frictionally-modified areas: adhesion=2.

The result obtained on frictionally-modified areas must be compared with that obtained on a non-phosphatized specimen which is nickel plated immediately after pickling to remove about 10 g/m$^2$ per face.

Referring to FIG. 1, it may be observed that, for this type of non-phosphatized specimen, the adhesion is only 4.

From this it may be deduced that, even on frictionally-modified areas, the degree of adhesion of the enamel coat is quite acceptable and that the amorphous phosphatization treatment remains effective even if the surface is frictionally modified substantially.

The forming operation therefore does not impair the surface reactivity, which makes it possible, according to the invention, to nickel plate immediately after forming, without having to repickle.

Still according to the invention, it is not necessary to protect particularly the phosphatization coat before carrying out the forming operation.

We claim:

1. A process for manufacturing an article made of direct-on enameled steel sheet, which process comprises a forming operation, a surface preparation operation in which a steel sheet surface is pickled under conditions which remove at most 15 gms of steel per square meter of sheet surface and then subjected to amorphous phosphatization with a phosphatization solution comprising less than 0.05 g/l of Ni and Mo under conditions which form a coat of at least 0.2 g/m$^2$ on the surface of said sheet followed by nickel plating, and an enameling operation, wherein in said process the forming operation is carried out after pickeling and after amorphous phosphatization.

2. The process as claimed in claim 1, wherein said nickel plating is conducted under conditions which deposit between 0.5 and 2.5 g/m$^2$ on the surface of said metal sheet.

3. The process as claimed in claim 1, wherein said nickel plating is carried out after the forming operation.

4. In a process for preparing the surface of a steel sheet for direct-on enameling, the improvement comprising:

pickeling the surface of said steel sheet under conditions which remove at most 15 gms of steel per square meter of said sheet surface;

subjecting said sheet to amorphous phosphatization with a phosphatization solution comprising less than 0.05 g/l of Ni and Mo so as to form a coat of at least 0.2 g/m$^2$ on a surface of said sheet; and nickel plating said pickeled and phosphatized metal surface.

5. The process as claimed in claim 4, wherein nickel plating is conducted so as to deposit between 0.5 and 2.5 g/m$^2$ on the surface of said pickeled and phosphatized sheet.

* * * * *